US005306138A

United States Patent [19]

Best

[11] Patent Number: 5,306,138

[45] Date of Patent: Apr. 26, 1994

[54] METHOD AND APPARATUS FOR INCINERATING COMBUSTIBLES CARRIED BY AN AIR STREAM

[76] Inventor: Willie H. Best, 18C The Heritage, Columbia, S.C. 29203

[21] Appl. No.: 848,748

[22] Filed: Mar. 10, 1992

[51] Int. Cl.[5] ..... F23D 14/00

[52] U.S. Cl. ..... 431/5; 431/11; 431/215; 431/242; 431/243; 431/247; 422/182; 422/204

[58] Field of Search ..... 431/354, 326, 5, 11, 431/242, 247, 248, 215, 207, 243, 7, 10; 110/212, 210; 422/182, 183, 203, 204

[56] References Cited

U.S. PATENT DOCUMENTS

| | | | |
|---|---|---|---|
| 3,468,634 | 9/1969 | Pauletta | 422/182 |
| 3,838,975 | 10/1974 | Tabak | 431/5 |
| 4,850,857 | 7/1989 | Obermuller | 431/5 |
| 5,062,788 | 11/1991 | Best | 431/7 |

FOREIGN PATENT DOCUMENTS

| | | | |
|---|---|---|---|
| 1188454 | 10/1985 | U.S.S.R. | 431/5 |

*Primary Examiner*—James C. Yeung
*Attorney, Agent, or Firm*—Hopkins & Thomas

[57] ABSTRACT

The incinerator has a closed housing (10) with high temperature insulation (17). A linear gas burner (50) is wholly within the bottom portion of the incineration chamber (22), producing a line of small flames (59). Polluted air, passing downwardly through vertically suspended heat exchanger tubes (47) wholly within the combustion chamber, is preheated and then discharged downwardly against the flames 59 of the linear burner (50), producing products of combustion and air heated to about 1400° F. The products of combustion and air pass upwardly and on opposite outer sides of the tubes (47) and exit the incinerator. The heated air and products of combustion heat the insulation sufficiently that it emits radiant energy inwardly for heating the tubes 47 by radiation, as the products of combustion and air heat the tubes 47 by convective heat transfer.

34 Claims, 6 Drawing Sheets

METHOD AND APPARATUS FOR INCINERATING COMBUSTIBLES CARRIED BY AN AIR STREAM

FIELD OF THE INVENTION

This invention relates to incinerators and is more particularly concerned with an apparatus and method for incinerating combustibles carried by an air stream.

BACKGROUND OF THE INVENTION

In the past, numerous incinerators have been devised in order to burn airborne organic matter entrained in air so as to convert the matter into essentially carbon dioxide and water vapor. Such incinerators have usually employed a preheater in the form of a heat exchanger provided with a plurality of tubes, through which the air and combustible matter passes, as these tubes are heated by the products of combustion being exhausted from the combustion chamber.

In the present day, more and more emphasis is being placed upon thoroughly incinerating all organic volatiles and other organic matter entrained in air, particularly the volatile organic compounds (VOC's) in air discharged from industrial plants. Such volatiles emanate from paint booths, drying ovens, and the like. In the past, such incinerators have usually been quite complex structures.

The concentration of VOC's contained in the atmosphere expelled from certain industrial processes, such as the exhaust from ovens used for curing various types of coatings, is usually much below a concentration required for producing a combustible mixture or even for the lower explosion limit (LEL).

Therefore, these VOC's have to be oxidized to harmless gases by incineration. They cannot be converted to products of combustion simply by being burned because of their low concentration in the mixture. However, when these compounds are exposed to an increased temperature for sufficient time in the presence of oxygen, they can be oxidized into harmless products of combustion. This process is usually accomplished at temperatures of between 1250° F. and 1500° F. and with dwell times for the organic matter from 0.2 seconds to 1 second.

In many applications where incineration of the VOC'S are required, the temperature of the mixture containing the VOC's is relatively low, 250° F. to 350° F. compared to the temperature required f or oxidation of the VOC's. Therefore, in order to conserve energy, most incinerators are of the recuperative type which allow for pre-heating the incoming mixture containing VOC's by the hot gases generated from the incineration process. Therefore, the energy added to accomplish the incineration can be greatly reduced if the incoming mixture can be separated from the combustion gases and pre-heated normally to about 1000° F. If pre-heating can be accomplished to this temperature, then the energy added to the mixture to be incinerated is only that required to heat the mixture from 1000° F. to the incineration temperature, which is usually in the range of 1250° F. to 1500° F.

In order to prewheat the incoming mixture containing the VOC's, some type of air-to-air heat exchanger is required. A typical heat exchanger used for this application would employ tubular heat transfer surfaces which could be constructed in many geometries. Most practical heat exchangers of this type use either cylindrical or rectangular tubular heat transfer surfaces.

In conventional incinerators employing pre-heating, it would not be desirable to mix the incoming polluted air mixture with the relatively clean air from the incineration process. Therefore, a gas tight seal is required to prevent the intermixing of the two. This gas tight seal is usually produced by welding the heat transfer tubular surfaces into headers. In many designs, the tube headers, in which the heat transfer tubes are welded, are exposed to the high exhaust gas temperatures of the incinerator. Failure of these welds and the heat exchangers associated with these types of incinerators have been a common problem in the past. Also, the failure of these heat exchangers has created expensive repairs.

A problem associated with the type of heat exchangers described above is that the resulting structure must provide for the expansion and contraction of the multiple tubes contained within one heat exchanger when different tubes are exposed to different temperatures. Carbide precipitation within the weld is another problem in prior art devices and in many instances, the weldment is subjected to high stresses as a result of the expansion and contraction of the heat transfer tubes.

Attempts have been made, in the past, to only weld one end of each heat transfer tube into one of the tube plates and allow the other end to float in the other tube plate. While this concept does provide for expansion and contraction of the tubes, it adds another design problem of providing a means to seal each tube while it expands and contracts within the tube plate. Thus, these types of incinerators have not been satisfactory or widely accepted because of leakage at the seal.

The present invention overcomes the difficulties prescribed above by providing an inexpensive and yet quite durable and efficient incinerator.

I have found that, to achieve virtually 100% destruction of VOC's, it is not necessary to provide a specific dwell time for the air and VOC mixture in the combustion chamber at a constant, specific, elevated temperature. In other words, the mixture of incoming air and VOC's does not have to be held at a specified constant temperature before it enters the primary heat exchanger. The rate at which the VOC's are oxidized depends upon, among other things, the temperature of the mixture. Thus, the dwell time required will depend upon the temperature versus time relationship experienced by the mixture as it passes through the combustion chamber.

In the preferred embodiment of this invention, the heat transfer to the incoming mixture occurs throughout the incineration chamber. This concept provides for more efficient heating of the incoming mixture while, at the same time, insuring that the time-temperature relationship, for essentially 100% destruction of the VOC's is maintained.

SUMMARY OF THE INVENTION

Briefly described, the present invention includes an incinerator in which high temperature insulation surrounds a central cavity. The insulation thus essentially surrounds all parts of the hollow combustion chamber. A semi-cylindrical cap having spaced slots therein divides the hollow interior of the housing into a lower combustion chamber and an upper gas discharge plenum. The heat exchanger tubes are vertically mounted by their upper ends and extend downwardly from a header extending across this semi-cylindrical cap. The heat transfer tubes thus terminate immediately above a linear burner and direct the air and entrained organic matter mixture, containing the VOC's, into the incineration or combustion chamber to admix with the gas and air mixture which form the flames in the combustion chamber. The housing surrounding and supporting the insulation is fabricated from structural and/or sheet steel and is lined with the high temperature insulation. Usually the insulation is capable of withstanding temperatures up to about 300° F. This insulation forms radiating surfaces for providing radiant heat to the heat exchanger tubes. The radiation energy transferred to the heat exchanger is given by the following equation:

$$Q_1 = -A_1E_1[\delta T_1^4 - \theta/\beta]$$

where $\theta = E_2\delta T_2^4 + E_1(1-E_2)\delta T_1^4 A_1/A_2$ $\beta = E_2 + E_1(1-E_2)A_1/A_2$ $Q_1$ = heat transfer to heat exchanger tubes outside $A_1$ = outside surface area of heat exchanger tubes $A_2$ = inside area of incineration chamber $T_1$ = absolute temperature of outside of heat exchanger surface $T_2$ = absolute temperature of inside incineration cbamber surface $\delta$ = Stefan Boltzmann constant $E_1$ = emissivity of heat exchanger tubes $E_2$ = emissivity of inside of incineration chamber The high temperature linear gas burner is wholly contained within the combustion or incinerator chamber. However, the structure of the burner can be mounted external to the incineration chamber provided the flame and products of combustion are directed into the incineration chamber. This high temperature linear gas fired burner (one typical type of burner that can be used is described in Best Patent No. 5,062,788) extends longitudinally across the incineration chamber, generally from one end to the other midway between the side walls, in order that the heat transfer tubes can discharge the polluted air directly into the flame zone of the burner and provide additional air for partial or total combustion of the combustible mixture emanating from the burner. The volume of the incineration or combustion chamber is sufficient to provide the required dwell time to completely oxidize the VOC's and other combustible organic material contained within the mixture, before the products of combustion are exhausted from the incineration chamber. Depending upon the type of VOC's incinerated, the dwell time for incineration usually varies from 0.2 seconds to 1 second.

The heat transfer tubes are preferably flat, rectangular tubular members located within the incineration chamber, however, they can be cylindrical in shape, also. When flat, rectangular tubes are used, the tubes can run parallel to the length of the burner of they can be placed perpendicular to the burner or at any other angle to the burner. Since the tubes are contained within the incineration chamber, the walls of the chamber can radiate directly to some surfaces of the tubes, therefore, heat is transferred to the outside surfaces of the tubes both by radiation and convection.

Since a portion of the heat energy absorbed by the incoming polluted air is transferred to the external surface of the heat transfer tubes by radiation, it is not as necessary to maintain extremely high velocities (excess of 10,000 ft/min) over the exterior surfaces of the tubes in order to generate a high convective heat transfer coefficient. The velocity of the gas flowing over the exterior surfaces of the heat transfer tubes is thus reduced while the proper heat transfer level is still maintained and the pressure drop across the heat exchanger is reduced. By reducing the pressure drop along the external surfaces of the heat exchanger, the horsepower required by the external blower, which delivers the polluted air under pressure, is greatly reduced. This reduced horsepower results in a direct operating savings of an incinerator designed in accordance with this invention.

An incinerator built in accordance with this invention enables the heat transfer tubes to be welded, only at the entrance ends of the tubes, which are thus remote from the area of combustion. The temperature of the exhaust products, at the area where the welds are exposed to these exhaust products, is at a minimum because of the counter current flow of the gases. In a typical application using this invention, the exhaust gas temperature from the combustion process is reduced to below 1000° F. at the area of the welds.

Also, the stresses resulting from expansion and contraction from the heat transfer tubes is reduced because one end of all heat transfer tubes is free to float, allowing unrestricted expansion and contraction of the tube without imparting a compressive stress on the weld or other junction.

A feature of the present invention is that a plurality of heat exchanger tubes, which preferably are rectangular in cross section are suspended by their upper end portions from the cap and communicate with the header. These heat exchanger tubes terminate in open ends within the central lower portion of the combustion chamber. A plurality of these heat exchanger tubes form the heat exchanger in a plane longitudinally across a major portion of the combustion chamber for preheating the incoming air.

The bottom portion of the housing of the incinerator is provided with a flat base plate, on which is disposed the linear gas burner.

The cap is provided with a plurality of transversely spaced holes or ports through which the products of combustion pass in an upward direction into the discharge plenum and, thence, is discharged from the incinerator through the air outlet duct.

The linear burner supplies flame, in an upwardly direction from the upper portion of the burner and longitudinally through a major portion of the combustion chamber so as to heat all of the air and its carbonaceous material simultaneously and convert the carbon to carbon dioxide and any hydrogen associated therewith into water vapor which travels upwardly past the heat exchanger tubes.

An incinerator built in accordance with the present invention lends itself well to modular construction and is quite compact since the combustion process occurs throughout the longitudinal length of the incinerator and is not concentrated in a single portion of the incinerator. This concept of construction allows the length of the incinerator to be varied based upon the volume of the polluted gases to be incinerated. However, if the longitudinal length of any one incinerator became impractical, the design enables two or more incinerators to be manifolded together, in parallel, to accommodate larger volumes of polluted air. As an example, a single incinerator normally accommodates 500 SCPM of polluted air. If the requirements for a particular process required incineration of 2000 SCFM, then four of the modular incinerators could be easily manifolded side-by-side, together.

During incineration, the generation of nitrogen oxides ($No_x$) is, among other things, dependent upon the time in which the nitrogen is exposed to the higher temperature of the flame. In other words, a compact burner, which burns millions of BTU/H in only a few feet of burner length, would require much longer flame lengths than if the combustion process were accomplished using longer burners for the same input and shorter flame lengths. In the incinerator of the present invention, the nitrogen in the air passing therethrough is not exposed to the temperature of the flame as long as in a conventional incinerator and the production of nitrogen oxides is, therefore, greatly reduced in the incinerator of the present invention.

Accordingly, it is an object of the present invention to provide an incinerator which is inexpensive to manufacture, durable in structure, and efficient in operation.

Another object of the present invention is to provide an incinerator in which the combustion process occurs over substantially the total length of the incinerator to provide an incineration dwell time sufficient to completely oxidize VOC's to harmless products of combustion.

Another object of the present invention is to provide an incinerator in which a primary heat exchanger discharges the polluted air directly into the incineration chamber at a point in which the VOC's will be exposed to incineration temperatures for sufficient time for them to be oxidized into harmless exhaust products.

Another object of the present invention is to provide an incinerator in which the discharge ends of the heat transfer tubes can be free floating and free to expand and contract within the incineration chamber.

Another object of the present invention is to provide an incinerator in which the combustion occurs along substantially the entire transverse length of the incinerator, reducing the flame length and therefore, greatly reducing the nitrous oxides generated by the combustion process.

Another object of the present invention is to provide an apparatus for and method in which an incoming mixture of air and organics can be discharged directly into the burner and provide either a portion or all of the air required for combustion.

Another object of the present invention is to provide an incinerator in which separate primary and/or secondary air for combustion is selectively supplied to the burner from outside fresh air or from an incoming mixture containing VOC'S.

Another object of the present invention is to provide an incinerator having a heat exchanger which is heated by both convection and radiation.

Another object of the present invention is to provide an incinerator in which the heat transfer coefficient internal to the heat transfer tubes can be varied by changing the velocity of the incoming mixture without appreciably varying the heat transfer area.

Another object of the present invention is to provide an incinerator, which is modular in design, and can be manifolded one to another to accommodate various volumes of mixtures containing VOC'S.

Another object of the present invention is to provide an incinerator assembly in which the individual modules are of such size and shape that they can be easily installed and maintained.

Another object of the present invention is to provide an incinerator that does not require a high pressure drop across the heat exchanger.

Another object of the present invention is to provide an incinerator which has a high efficiency and a long, useful life, and is made up of components which are readily and easily replaced.

Another object of the present invention is to provide an incinerator in which the burner is easily accessible and requires little maintenance.

Another object of the present invention is to provide an incinerator and process of destroying VOC's, easily and effectively, burning more than 99% of the VOC's, when required.

Another object of the present invention is to provide an incinerator which has excellent heat transfer characteristics.

Another objection of the present invention is to provide an apparatus and method of incinerating carbonaceous, airborne material so as to produce a maximum amount of carbon dioxide and a maximum amount of water vapor while also limiting the conversion of molecular nitrogen into nitrous oxide ($NO_x$).

Another object of the present invention is to provide an incinerator which will utilize a vast majority of its radiant heat for the preheating of the incoming air.

Another object of the present invention is to provide an incinerator which requires a minimum of welding of its heat exchanger tubes.

Another object of the present invention is to provide an incinerator which will utilize the insulation which surrounds the combustion chamber as radiant energy emitters for directing the radiant energy heat against the sides of the heat exchanger and also for retransmitting its received radiant energy.

Another object of the present invention is to provide, in an incinerator, the utilization of the maximum amount of radiant energy.

Another object of the present invention is to provide an incinerator having a heat exchanger which will discharge the preheated air into the flame of the incinerator.

Another object of the present invention is to provide an apparatus and method for incinerating air in which the utilization of the input heat is at a maximum.

Another object of the present invention is to provide an apparatus and method of incinerating wherein the path of the air through a preheater is reduced to a minimum.

Other objects, features, and advantages of the present invention will become apparent from the following description when considered in conjunction with the accompanying drawings wherein like characters of reference designate corresponding parts throughout the several views and wherein.

DETAILED DESCRIPTION

Figure 1:
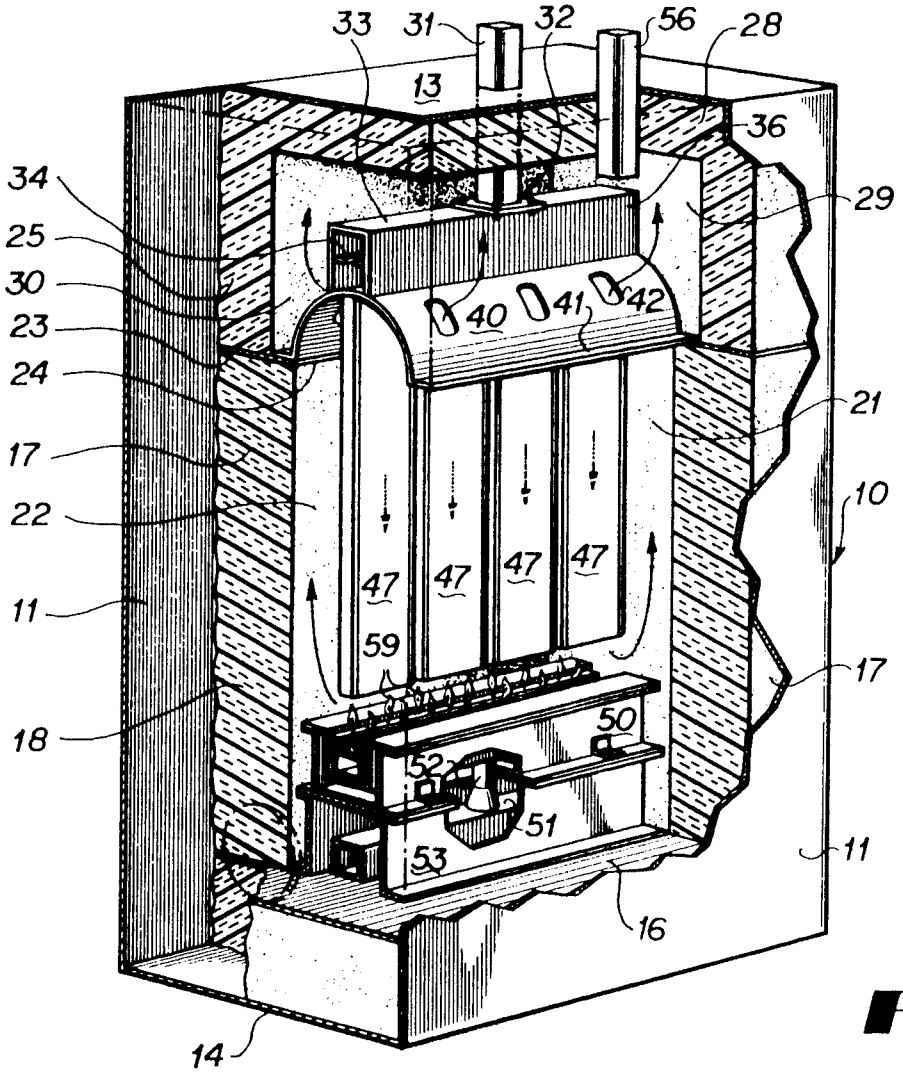
FIG. 1 is an exploded fragmentary perspective view of an incinerator constructed in accordance with the present invention.

Referring now in detail to the embodiment chosen for the purpose of illustrating the present invention, numeral 10 denotes generally a metal housing having spaced, opposed, parallel, upright, longitudinally extending side panels 11, the adjacent ends of which are joined by spaced, upright, parallel, transversely extending, end panels 12, the panels 11 and 12 forming, in cross-section, a rectangle having a hollow interior.

The upper edges of the panels 11 and 12 are in a horizontal plant and are joined by a flat, horizontally disposed upper or top panel or plate 13. The lower edges of panels 11 and 12 are joined by a lower, flat, horizontal, rectangular panel 14.

The bottom panel 14 is covered by a rectangular block of high temperature insulation, denoted by numeral 15. The upper surface of this insulation 15 is generally flat and horizontally disposed over this upper surface is a flat, horizontal base plate 16 which covers bottom insulation 15.

Rectangular side blocks 17 of insulation material are provided against the inner surfaces of the side panels 11, these insulation blocks 17 terminating in flat, horizontal upper surfaces which are spaced below and parallel to the top panel 13. End insulation blocks 18 are provided along the inner surf aces of the end panels 12, the insulation blocks 17 and 18 resting upon the base plate 16 and terminating inwardly of the top panel or plate 13 so that their upper surfaces are disposed in a horizontal plane inwardly of and parallel to the top panel or plate 13.

The inner surfaces 20 of side blocks 17 are generally in flat, vertical longitudinal planes which are spaced, in parallel relationship to each other, while the inner surfaces 21 of the blocks 18 are flat, parallel surfaces which, together with the surfaces 20 define an upright, rectangular combustion or incinerator chamber 22 for the incinerator housing 10. Mounted on the upper edges of the insulation blocks 17 and 18 is a sheet metal hood supporting plate 23 which has a rectangular central opening 24 corresponding to the dimensions of the cross-section of the combustion chamber 22. The support plate 23 is welded to the inner surfaces of the panels 11 and 12.

Above the hood support plate or partition 23 are the high temperature insulation upper side blocks 25 which are disposed inwardly against the inner surfaces of the side panels 11 and above insulation blocks 17. These insulation blocks 25 permit the partition 23 to provide a support ledge around the perimeter, defined by the opening 24. In like fashion, the panels 12 are provided with upper insulation blocks 27 which are slightly thinner than the insulation blocks 18. These insulation blocks 25 and 27 terminate in upper edges in a common horizontal plane and on which is disposed a rectangular upper insulation block 28 which abuts against the inner or bottom surface of the top panel 13. Thus, the blocks 25, 27, and 28 define an upper plenum chamber 30.

Figure 3:
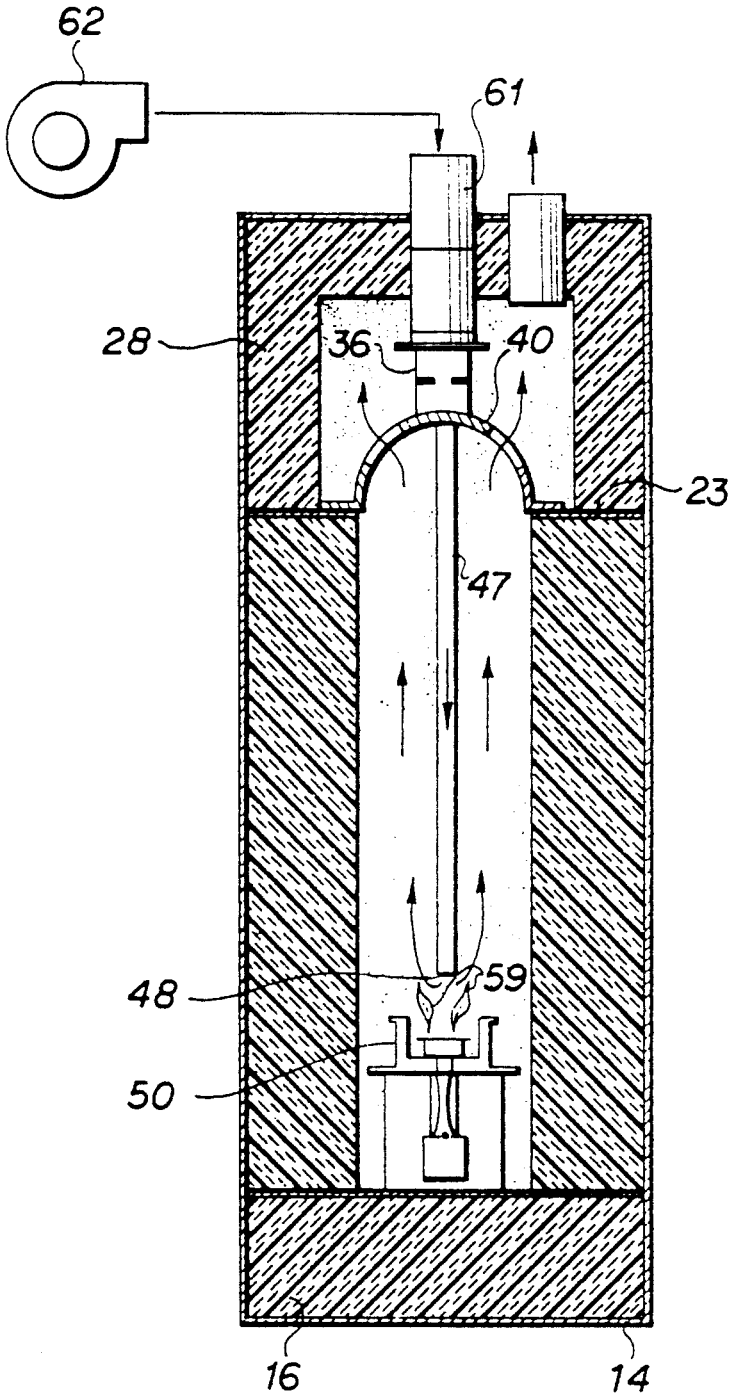
FIG. 3 is a longitudinal vertical sectional view of the incinerator depicted in FIGS. 1 and 2.
Figure 4:
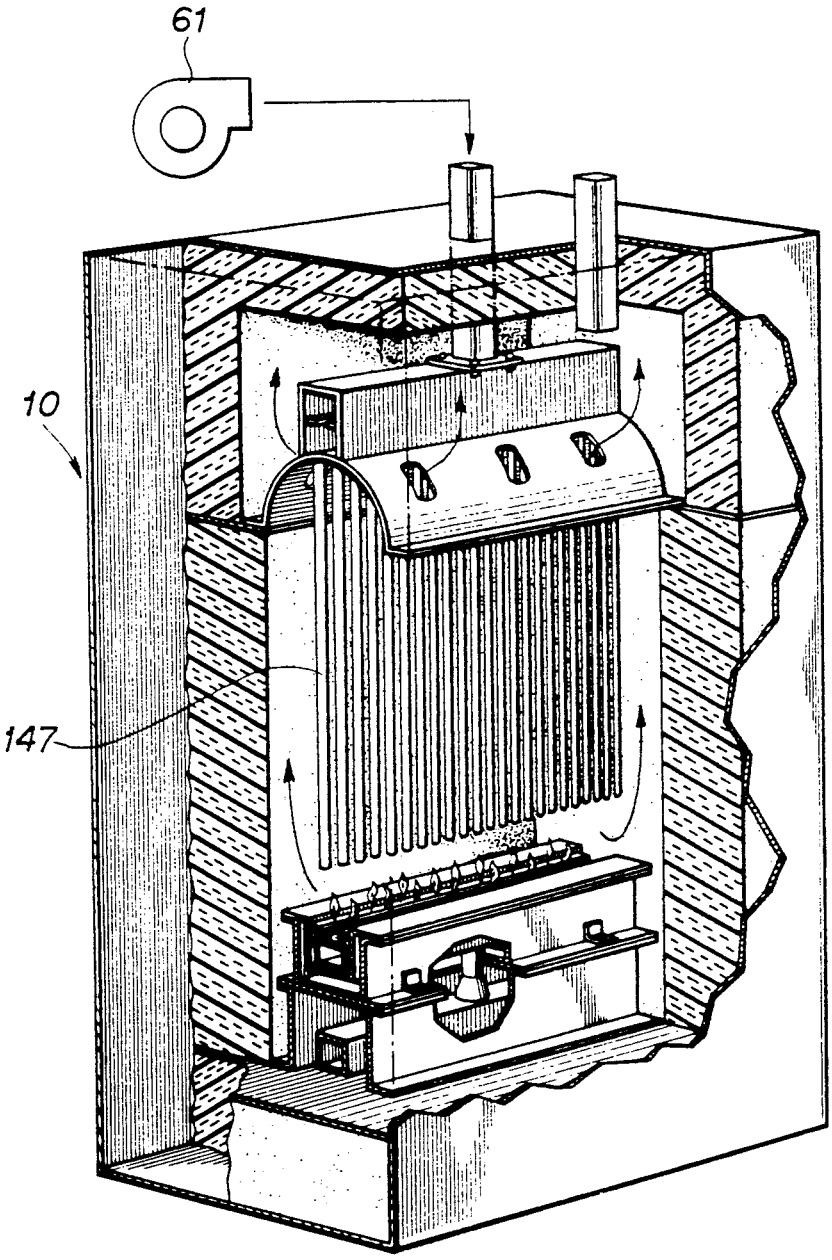
FIG. 4 is a perspective view similar to FIG. 1 and showing a modified form of the present invention, in which the heat exchanger tubes are cylindrical rather than rectangular.

At the center of the top panel 13 and the center or insulation block 28 is a downwardly extending air intake conduit or duct 31 which protrudes into the plenum chamber 30 and terminates in an annular butt flange 32. This butt flange 32 is received on the upper flat surface of a horizontally disposed, longitudinally extending header 33 so that the duct 31 communicates with the central upper portion of header 33. The header 33 extends throughout substantially the longitudinal length of the plenum chamber 30 and is fixed in a horizontal position, as best seen in FIG. 3, the header 33 being closed at its ends.

A horizontal diffusion plate 34 is provided within the header 33, this diffusion plate 34 being provided with a plurality of longitudinally spaced holes 35. The header 33 includes a top plate 43 and side plates 36, the lower edges of which are welded to the upper central surface of a semi-cylindrical, downwardly concaved, longitudinally extending combustion chamber cap 40 which extends outwardly of the header 33 on both ends, as seen in FIG. 3. This combustion chamber cap 40 is arcuate about a longitudinal, horizontal, central axis which is about on a plane of the plane of the plate 23. The lower surface of the cap 40 is thus concaved and the upper surface of cap 40 is convexed. A pair of spaced, diametrically opposed flanges 41 respectively protrude outwardly from the lower edges of the cap 40 and over the surfaces of the plate 23 so that the plate 23 supports the cap 40 by these flanges 41.

On opposite sides of the cap 40 there are provided a plurality of longitudinally spaced, elongated holes or slots 42, through which air may readily pass from the combustion chamber 22 into the plenum chamber 30.

The upper central portion of the cap 40 with header 33 is provided with a plurality of longitudinally aligned, rectangular holes (not shown) which are aligned axially, therealong. Through these rectangular holes (not shown) respectively protrude a like number of heat exchanger tubes or conduits 47 which have upper flanges, such as flange 45, which are welded to the upper surface of the cap 40. Each of the heat exchanger tubes or conduits 47 is rectangular in cross-section and is longitudinally elongated so as to provide open ended ducts, the lower discharge end 48 of which form a discharge mouth or port for discharging the air and combustibles in a downward direction into the lower central portion of the combustion chamber 22. It is thus seen that the heat exchanger tubes ducts 47 are suspended solely by their upper flanges 45 which are welded to the cap 40, within header 33. The header and suspended tubes 47 form a heat exchanger, within which the stream of air and combustibles are penetrated.

On the bottom plate 16 wholly inside the combustion chamber is a longitudinally extending linear gas burner 50 which is constructed in accordance with the teachings of my U.S. Pat. No. 5,062,788. This linear burner 50 has a longitudinally extending gas pipe 51 provided with one or more longitudinally extending, upstanding venturi mixing tubes 52. These mixing tubes 52 feed the gas from gas conduit 51 and primary air from a longitudinally extending air plenum or chamber 53 to the horizontal, flat, juxtaposed lower and upper burner plates 47 and 58 which extend the length of the longitudinally extending linear burner 50. The plates 57 and 58 have offset holes (not shown) and are in a U-shaped trough which contains the longitudinally aligned row of individual flames immediately below the lower discharge ends, port or openings 48 of all of the heat exchanger tubes 47. The spaced aligned flames 59 are created by gas and air passing through the aligned longitudinally equally spaced holes in outer or upper plates 58 of the linear burner 50 and are distributed along the length of the upper portion of the burner 50 so that the flames are beneath all of the discharge ends, openings or ports 48 and so that streams of air and combustibles are discharged directly toward the burner 50.

Figure 7:
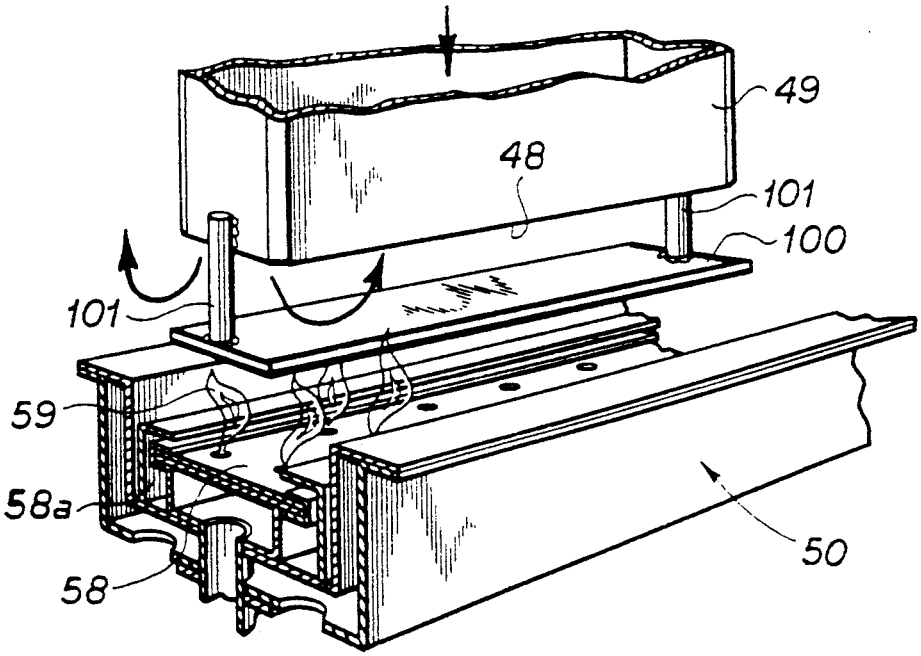
FIG. 7 is a fragmentary, perspective view of a portion of the structure shown in FIG. 1 and showing a deflector for deflecting the polluted air passing from the heat exchanger of FIG. 1.

The burner 50 may have one or a plurality of rows of, such as, holes 58*a* or 158*a* for producing a uniform heat source across the burner 50. In FIGS. 1 and 7, I have illustrated the holes 58*a* of the upper plate 58 as being aligned longitudinally in two longitudinal rows for producing two parallel rows of individual flames 59.

Figure 5:
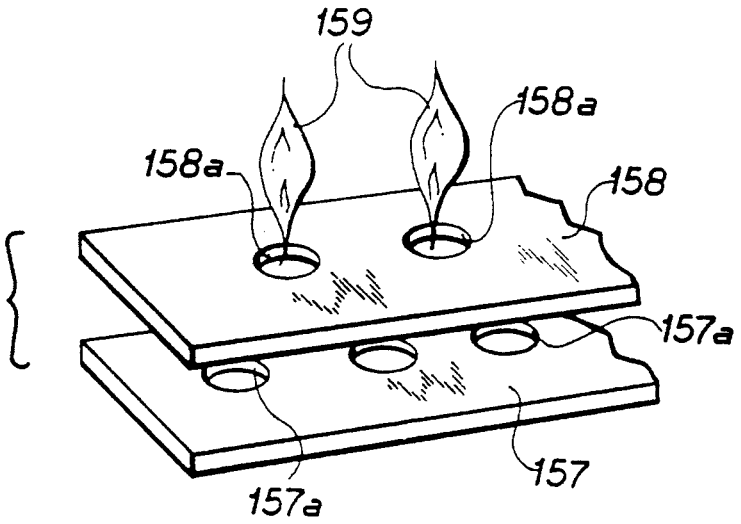
FIG. 5 is an exploded, fragmentary, perspective view of the plates of one form of the linear burner for the incinerator shown in FIG. 1.
Figure 6:
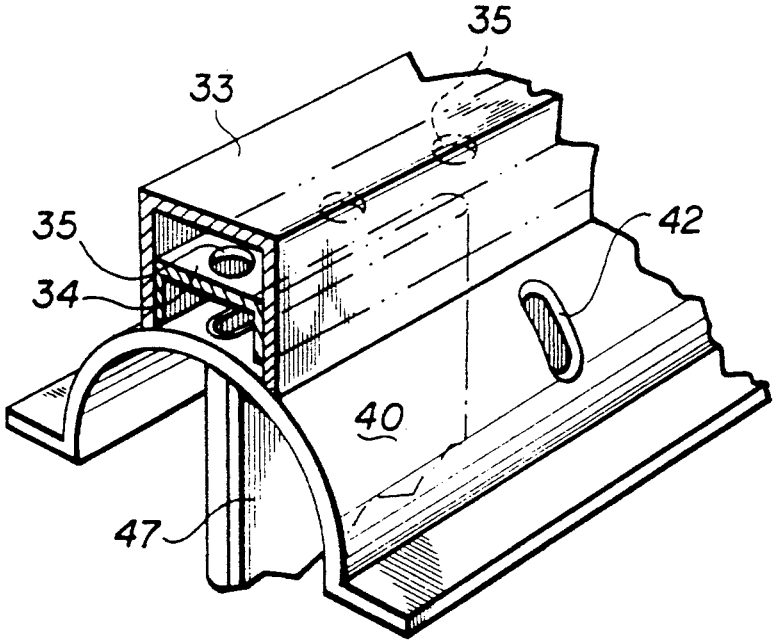
FIG. 6 is a fragmentary, perspective view of a portion of the header, cap, and a heat exchanger tube of the incinerator of FIG. 1.

In FIG. 5 is illustrated the lower plate 157 and upper plate 158 having longitudinally, equally spaced holes 157*a* in plate 157 and equally, longitudinally spaced holes 158*a* in plate 158, the holes 158*a* being offset from the holes 157*a* and providing a single, straight, longitudinal line or row of flames 159 along the length of the combustion chamber 35.

In FIG. 7, it is seen that, if desired, a horizontally disposed baffle 100 is optionally provided on the end portion of each heat exchanger tube 47. This baffle is a flat, rectangular plate suspended from tube 47 by a pair of brackets 101. Each baffle 100 is about the same dimension as end 48 of tube 47 and is held in a fixed position spaced downwardly from end 48 and above the burner plate 58, so that equal amounts of polluted air from tube 47 are directed to opposite sides of tube 47 and heated by flames 59.

Access to the burner 50 is provided through an access port 55 in one of the side panels 12, the burner 50 having an external blower 60 which delivers ambient air to the air plenum or chamber 53.

At the upper end of the housing 10, adjacent to the air intake duct or conduit 31 and protruding through the top panel 13 is an air discharge duct or conduit 56. All air discharged from the interior of the incinerator passes through this single discharge conduit 56. All air coming into the incinerator, with the exception of the ambient air which may be supplied through the air blower 60 is fed through the air intake conduit 31. This air intake conduit 31 is connected to a second blower 61, such as a discharge blower from one or several paint booths or ovens which provide VOC and air to be incinerated. An air valve 62 controls the volume of air, under pressure, fed through conduit 31.

The heat exchangers, namely the heat exchanger tubes 47 are disposed midway between and parallel to the inner radiant emitter walls 20 of the insulation blocks 17 and perpendicular to the walls 21. These upright, rectangular conduits have their flat, opposed sides 47 arranged in two parallel planes and disposed opposite to the respective inner surfaces 20, the tubes 47 being midway between the inner walls 20 and essentially along a common upright plane which is equidistant between the two opposed walls 20.

If desired, round or cylindrical tubes 147 may be substituted for the rectangular heat exchanger tubes 47. Actually, these round heat exchanger tubes are less effective than the rectangular tubes 47 but are, nevertheless, quite efficient due to the fact that the heat transfer characteristics of the enclosure around the tube are such that it approaches the appearance of a black box in that the combined emissivities have the effect of approaching or being nearly equal to 1.

OPERATION

In operation, the incinerator of the present invention operates quite efficiently. Air under pressure, together with its occluded combustible carbonaceous matter, such as the volatile organic compounds (VOC's) are delivered from an appropriate exhaust or second blower 61 of an apparatus, such as a paint spray booth (not shown) or a paint drying oven (not shown) past an appropriate valve 62 and into the heat exchanger of the incinerator, via the air intake duct or conduit 31. Thence, this polluted air mixture travels downwardly in the conduit 31 into the dome shaped plenum or header 33. The air mixture then enters the header 33, spreads out laterally and is forced through the longitudinally spaced holes 35 so as to be discharged into the lower chamber of the header 33 and into the upper intake ends of the various downwardly extending heat exchanger tubes 47.

The baffle 34 evenly distributes the mixture of polluted air such that an equal amount of mixture will enter each heat transfer tube 47. The mixture (polluted air) is then discharged through the discharge end of the heat transfer tube 47. The mixture can be discharged into the incineration chamber, independent of providing combustion air to the burner 50, or the incoming polluted air can be used to provide for the secondary air for combustion of the burner 50 or if the pollution is limited strictly to VOC's, the incoming mixture can provide for total combustion air of the burner 50.

The heat, from products of combustion of the burner 50 heats the inner surfaces 20 and 21 in the combustion or incineration chamber so that these inner walls, even though not of material which would normally be considered radiant emitters, nevertheless emit heat, as radiant energy, against both sides 47*a* which are disposed adjacent and parallel to the walls 20, respectively. The polluted air mixture is delivered from an oven via conduit 31 at about 300° F. when it enters the header 33 and this polluted air mixture is progressively heated, primarily by radiant energy, as the air mixture passes downwardly through the tubes 47 and is discharged from the lower discharge ends 48. At that time, the air has been heated from about 300° F. to about 1000° F. as it is discharged downwardly and flows downwardly and outwardly and, thence, upwardly as indicated by the arrows in FIG. 3. In this flame area, the polluted air mixture is discharged directly toward the U-shaped trough and aligned equally spaced longitudinally extending row of flames 59 of the burner 50. Thus, this polluted air acts as secondary air in providing for complete combustion of the gas fuel of burner 50, and provides good conditions for all of the carbonaceous material, i.e., VOC's, to be converted to carbon dioxide and all of the hydrogen in the carbonaceous material to be converted to water vapor or gaseous water, as the case may be.

The products of combustion from burner 50 along with the air which is being incinerated progressively move upwardly in the incineration chamber 22, being heated to between about 1250° F. and about 1500° F., along surfaces 20, 21, and 47*a* so as to heat these surfaces by convection. Thus, surfaces 20, 21, and 47*a* receive energy by convection from the combustion products as well as radiant energy from incinerator walls 20 and 21. Radiant energy emitted by the incinerator walls 21 is absorbed by heat exchanger tubes 47 or travels again to walls 21 where it is absorbed and reemitted. Interior surfaces of cap 40 also radiate energy towards tubes 47. The flow of gases in the incineration chamber 22 is such that there is a dwell time of the gases for between 0.2 seconds and 1 second.

In the event the incoming polluted air mixture contained other contaminants, it might not be practical to force this air through the burner 50 to provide the combustion air. In such an instance, a more efficient incinerator might be possible by using a clean external ambient air source solely through blower 60 for the combustion air to burner 50, to preclude the possibility of clogging the burner 50 due to the formation of contaminants from the mixture. However, dependent upon the level of contaminants, the primary air for combustion to the burner 50 can be supplied from an external fresh air source with all of the secondary air for combustion provided by the mixture. If the mixture contained only clean VOC's, then it would be permissible for all of the combustion air to the burner 50 to be provided from the mixture containing the VOC's.

Experimental data has shown that with minor modifications, the burner, as illustrated, can operate efficiently when some or all of the primary air for combustion is provided from the incoming mixture containing the VOC's, without preheating.

When all of the air for combustion is provided from the incoming mixture, a small portion of the air can be directed into the air plenum 53 which will provide primary and secondary air to the burner 50 independently of that which is supplied through heat transfer tubes 47 and discharged through discharge end 48.

One consideration in determining the amount of primary and secondary air for combustion, independent of the air from the heat transfer tubes 47, is the requirement to keep nitrous oxides to a minimum. My experimentations have demonstrated quite vividly that the nitrous oxides ($NO_x$) are reduced to an absolute minimum when the flame length is kept very short. My tests have demonstrated that the production of nitrous oxide (No.,) in my linear burner 50 are fourteen times less, for the same BTU/H input, than in conventional air type burners.

The cross-sectional area of the internal volume of the incinerator will provide for a velocity of the gases progressing toward the exhaust or discharge duct 56 such that each element of the mixture will be exposed to the incineration temperatures for a dwell time required for the complete oxidation of the volatile organic compounds (VOC's). This dwell time can vary from a few tenths of a second to more than a second, depending upon the chemical structure of the pollutant.

In any event, the pollution is discharged from the heat exchanger tubes 47 at about 1000° F. into the incineration or combustion chamber 22 and is immediately exposed to temperatures which will cause oxidation of the VOC's (1250° to about 1500° F.). Where the products of combustion are discharged through the discharge duct 56, tests have demonstrated essentially one hundred percent (99%+) destruction of the VOC's when sufficient incineration temperature and dwell time are provided. The incineration temperatures may be quite hot since my linear burner may exist and function properly in an environment up to 2000° F.

When rectangular heat transfer tubes 47 (which is the preferred embodiment) are used, the cross-sectional flow area can be changed by a slight modification of the transverse dimension X without altering longitudinal dimension Y. This provides the ability to vary the velocity of the mixture within the tube without an appreciable effect on the total heat transfer area. Obviously, this would not be the case to the same extent if the tube were circular.

Figure 2:
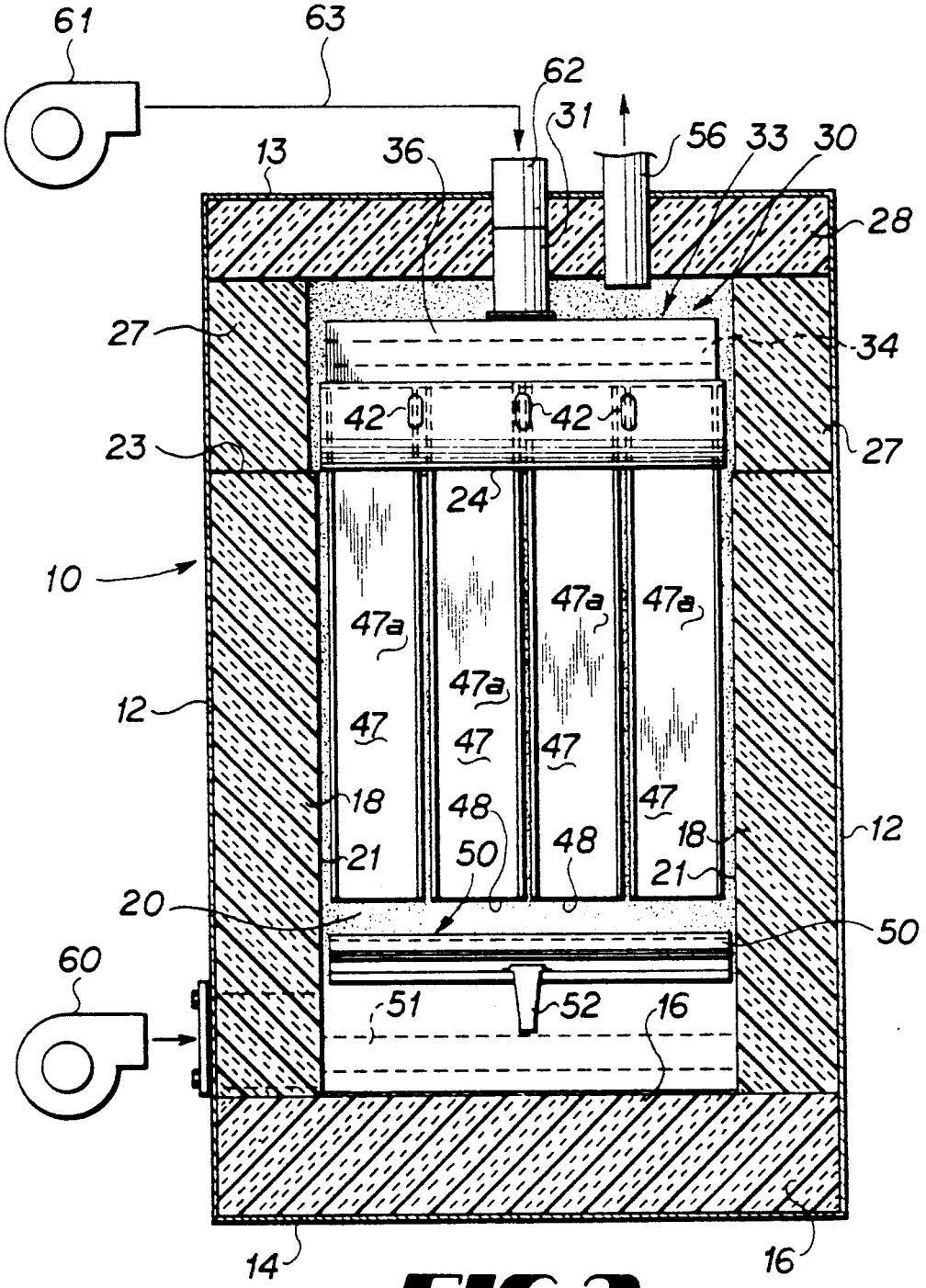
FIG. 2 is a transverse vertical sectional view of the incinerator depicted in FIG. 1.

Usually a modular unit, such as that depicted herein, should handle about 400 CFM's of air. From viewing FIG. 2 it will be seen that the incinerator of the present invention is essentially symmetrical along a vertical or upright plane passing along the axes of the heat exchanger conduits 47.

It will be obvious to those skilled in the art that many variations may be made in the embodiment here chosen for the purpose of illustrating the present invention without departing from the scope thereof as defined by the appended claims.

I claim:

1. Process for incinerating combustibles which are carried by an air stream, comprising the steps of:

(a) passing said air stream progressively along a confined plurality of individual parallel first paths in a first direction in an incineration chamber;

(b) progressively discharging said air stream from said confined first paths into said combustion chamber as individual progressively discharging air streams;

(c) applying flames produced by a combustible mixture simultaneously to said discharging air streams as the discharging air streams simultaneously emerge from said confined paths so that said discharging air streams simultaneously supply oxygen and combustibles to the flames and so that the combustibles carried by said discharging air streams are progressively oxidized for producing heated gases containing air, the products of combustion and the oxidized combustibles; and (d) directing the heated gases progressively in countercurrent flow along a second path adjacent to said confined paths and in a second direction opposite to said first direction so that said heated gases progressively simultaneously heat the confined air streams in said first paths as said heated gases pass progressively along said second path.

2. An incinerator for burning combustibles carried by a stream of air comprising:

(a) a housing having a hollow incineration chamber therein, said incineration chamber including opposed emitter walls;

(b) a fuel fired burner capable of releasing the energy of combustion into said incineration chamber;

(c) means for providing fuel to said burner;

(d) heat exchanger tube within said incineration chamber, said heat exchanger tube being provided with an inlet end for receiving said stream of air and a discharge end for discharging said air after it has been preheated in said heat exchanger tube, said discharge end opening into said incinerator chamber, support means for suspending said heat exchanger tube between said walls by its upper portion and so that said tube is freely pendent from said support means and is capable of independent elongation expansion and contraction; and (e) said gas burner simultaneously heating said incinerator chamber wall and said heat exchanger tube by the passage of gases upwardly therebetween.

3. The incinerator defined in claim 2 wherein said burner is essentially wholly contained within said incineration chamber.

4. The incinerator defined in claim 2 wherein said burner is a linear burner which extends essentially across the incinerator in a direction normal to the axes of the tubes.

5. The incinerator defined in claim 2 including additional heat exchanger tubes disposed in juxtaposition to said heat exchanger tube, each of said additional heat exchanger tubes having an inlet end for receiving said stream of air and a discharge end for discharging said air, each of said additional heat exchanger tubes being suspended by said support means and being freely pendent so as to be capable of independent elongation expansion and contraction.

6. The incinerator defined in claim 5 wherein said heat exchanger tubes are disposed in transverse alignment and said gas burner being disposed below and adjacent to the discharge ends of said heat exchanger tube and said heat exchanger tubes.

7. The incinerator defined in claim 5 wherein said burner is a linear burner having flames which ignite the combustible portions of said stream of air as the combustible portions of said stream of air emerge from the ends of said heat exchanger tube and said heat exchanger tubes.

8. The incinerator defined in claim 2 wherein said gas burner is disposed beneath said heat exchanger tube for igniting the combustibles in said stream of air as said air is discharged from the discharge end of said heat exchanger tube.

9. The incinerator defined in claim 2 wherein said gas burner is disposed immediately below the discharge end of said heat exchanger tube and when ignited has a flame which ignites the combustibles emerging with said air from the discharge end of said discharge tube.

10. The incinerator defined in claim 9 wherein said opposed emitter walls are essentially straight and disposed parallel to each other and said heat exchanger tube is disposed parallel to said emitter walls.

11. The incinerator defined in claim 2 wherein said opposed emitter walls are parallel to each other and wherein said heat exchanger tube is disposed generally parallel to said emitter walls and wherein said fuel fired burner is disposed immediately below the discharge end of said heat exchanger tube.

12. An incinerator for burning combustibles carried by a stream of air, comprising:

(a) a housing having a hollow incineration chamber;

(b) a linear burner essentially wholly within said incineration chamber;

(c) means for providing gas and air to said linear burner for being mixed within said burner and within said incineration chamber for being burned by said linear burner within said incineration chamber;

(d) a heat exchanger within the central portion of said incineration chamber, said heat exchanger having a discharge opening for directing a discharge from said heat exchanger directly toward said burner in said incineration chamber;

(e) means for supplying said stream of air and combustibles to said heat exchanger, said stream passing through said heat exchanger and thence being discharged through said discharge opening into said incineration chamber and toward said burner; and (f) an outlet duct communicating with said incineration chamber.

13. The incinerator defined in claim 12 wherein said linear burner has burner ports aligned with each other for producing a plurality of flames longitudinally across said incinerator chamber.

14. The incinerator defined in claim 12 including means for supplying gas to said burner and means connected to said discharge opening for directing said stream directly through the flames of said burner for admixing with gas of said burner and for providing secondary air for said flame of said burner.

15. The incinerator defined in claim 12 wherein said heat exchanger includes a plurality of tubes suspended and aligned side-by-side within said incineration chamber and over said burner, said tubes being supported solely by their upper end portions, said tubes discharging said stream through their lower ends into the lower portion of said incineration chamber, said burner being located in the lower portion of said incineration chamber.

16. The incinerator defined in claim 15 including emitter walls disposed on opposite sides of said tubes for directing radiant energy from said emitters against said sides when said emitters are heated within said incineration chamber.

17. The incinerator defined in claim 12 wherein said housing is provided with opposed radiant energy emitters which are heated by the heat within said incinerator chamber, said emitters emitting radiant heat toward said heat exchanger.

18. The incinerator defined in claim 17 wherein said heat exchanger includes a plurality of tubes suspended between said emitters.

19. An incinerator for burning combustibles carried by a stream of air, comprising:

(a) a housing having a hollow incineration chamber;

(b) a linear burner essentially wholly within said incineration chamber;

(c) means for providing gas and air to said linear burner for being mixed within said burner and within said incineration chamber for being burned by said linear burner within said incineration chamber;

(d) a heat exchanger within said incineration chamber, said heat exchanger being provided with a discharge opening into said incineration chamber;

(e) means for supplying said stream of air and combustibles to said heat exchanger, said stream passing through said heat exchanger and thence being discharged through said discharge opening into said incineration chamber;

(f) an outlet duct communicating with said incineration chamber, (g) said linear burner having burner ports aligned with each other for producing a plurality of flames longitudinally across said incinerator chamber; and (h) said discharge opening in said heat exchanger including a plurality of narrow ports aligned with each other and adjacent to said heat exchanger for discharging said stream, toward said flame and for distributing the flow of said stream longitudinally across essentially all of said flames.

20. An incinerator for progressively burning combustibles carried by a stream of polluted air, comprising:

(a) a housing defining a hollow interior;

(b) a linear burner having a body disposed essentially wholly within said hollow interior; said burner including a pair of juxtaposed inner and outer burner plates carried by said body and having offset holes in the respective plates, said outer plate having its holes spaced from each other along a prescribed length;

(c) means for supplying air and gas to the inner plate so that the air and gas pass through the holes in said inner plate and emerge from the holes of the outer plate to provide spaced flames within said interior; and (d) a heat exchanger within said hollow interior for heating said stream of polluted air and for discharging the same for being oxidized by said flames.

21. The incinerator defined in claim 20 wherein said heat exchanger includes a plurality of heat exchanger tubes disposed in said hollow interior in alignment over the burner, one end of sad tubes being connected to an air inlet through which said stream of air passes and the other ends of said tubes terminating adjacent said heater for directing said air and combustibles toward said flames.

22. The incinerator defined in claim 21 including a header connected to all of the inlet ends of said tubes and communicating therewith for directing said air into said inlet ends of said tubes, said tubes being suspended from said header.

23. The incinerator defined in claim 22 wherein said inlet ends of said heat exchanger tubes are welded to said header.

24. The incinerator defined in claim 23 including means for regulating the air fed to said heat exchanger.

25. The incinerator defined in claim 20 wherein said housing has opposed parallel sides and said heat exchanger includes a plurality of individual tubes disposed in straight alignment and between the sides of said housing, said tubes being rectangular in cross-section and having side plates which are in common planes parallel to each other, said common planes also being parallel to the sides of said housing.

26. The incinerator defined in claim 20 including high temperature insulation disposed within said hollow interior and supported by said housing. said insulating surrounding said heat exchanger and forming radiant elements for directing radiant heat against said heat exchanger.

27. The incinerator defined in claim 26 wherein said heat exchanger comprises a plurality of tubes disposed in a common plane parallel to the surfaces of said insulation.

28. An incinerator for progressively burning combustibles carried in an air stream, comprising:

(a) a housing defining an open interior;

(b) insulation within said open interior, said insulation having opposed walls and defining an incineration chamber;

(c) a burner in said incineration chamber, said burner providing a series of flames between said opposed walls;

(d) a heat exchanger disposed between said opposed walls and within said incineration chamber, said heat exchanger having an inlet end for receiving said air and a discharge end for discharging the stream of air toward said burner; and (e) means for supporting said heat exchanger within said incineration chamber so that the products of combustion from said burner pass on opposite sides of said heat exchanger in passing out of said combustion chamber and a discharge duct through which the products of combustion which pass adjacent to said heat exchanger are discharged from said incinerator.

29. The incinerator defined in claim 28 wherein said burner is located i the lower portion of said incineration chamber and said exit duct is located in the upper portion of said chamber for producing a path of travel of the products of combustion from said burner in an upwardly direction to and out of said discharge duct and wherein said heat exchanger includes a plurality of tubes suspended essentially vertically in said combustion chamber in spaced relationship to the opposed side walls of said insulation.

30. The incinerator defined in claim 29 wherein said burner is a linear gas burner for forming a plurality of flames longitudinally along the bottom portion of said incineration chamber wherein said heat exchanger discharges said air in a thin wide stream toward said flame.

31. The linear burner defined in claim 30 wherein said heat exchanger includes a header disposed longitudinally in the upper portion of said incineration chamber, said burner being disposed in the lower portion of said incineration chamber and said heat exchanger including a plurality of tubes suspended from said header.

32. The incinerator defined in claim 31 wherein said tubes are each rectangular in cross-section, said tubes having opposed sides which are disposed in spaced relationship to each other and in spaced relationship to said opposed walls.

33. The incinerator defined in claim 28 wherein said heat exchanger includes a plurality of juxtaposed tubular members which are suspended within said incineration chamber said tubes having discharge ends terminating adjacent to said burner for discharging air in the vicinity of said flame.

34. The incinerator defined in claim 33 wherein said burner is a linear burner for providing a narrow longitudinal flame and wherein said air is discharged vertically downwardly onto essentially all portions of said flame.

* * * * *